US009404499B2

(12) United States Patent
Seibel et al.

(10) Patent No.: US 9,404,499 B2
(45) Date of Patent: Aug. 2, 2016

(54) DUAL CHAMBER DISCHARGE MUFFLER

(75) Inventors: Stephen M. Seibel, Celina, OH (US); Christopher Stover, Versailles, OH (US); Roy J. Doepker, Lima, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 2004 days.

(21) Appl. No.: 11/998,441

(22) Filed: Nov. 29, 2007

(65) Prior Publication Data

US 2008/0145242 A1 Jun. 19, 2008

Related U.S. Application Data

(60) Provisional application No. 60/872,589, filed on Dec. 1, 2006.

(51) Int. Cl.
*F04C 29/06* (2006.01)
*F04C 18/02* (2006.01)
*F04C 23/00* (2006.01)

(52) U.S. Cl.
CPC ..... *F04C 29/065* (2013.01); *F04C 18/0215* (2013.01); *F04C 23/008* (2013.01)

(58) Field of Classification Search
CPC .. F04B 11/00; F04B 39/0027; F04C 18/0215; F04C 23/008; F04C 29/06; F04C 29/065
USPC ..... 417/312, 410.5; 181/254, 403
See application file for complete search history.

(56) References Cited

U.S. PATENT DOCUMENTS 3,006,160 A 10/1961 Heidorn
3,612,216 A * 10/1971 Rieder ..... 181/265
4,418,790 A 12/1983 Agnew
4,431,388 A * 2/1984 Eber et al. ..... 418/55.1
4,759,422 A 7/1988 Belley
4,815,951 A 3/1989 Kakuda et al.
4,854,417 A * 8/1989 Uesugi et al. ..... 181/272
4,865,531 A 9/1989 Kakuda et al.
5,022,146 A 6/1991 Gannaway et al.
5,074,760 A 12/1991 Hirooka et al.
5,108,274 A 4/1992 Kakuda et al.
5,208,429 A * 5/1993 Field ..... 181/229
5,213,489 A 5/1993 Kawahara et al.
5,339,652 A 8/1994 Dreiman
5,342,183 A 8/1994 Rafalovich et al.
5,348,267 A 9/1994 Lanting et al.
5,395,214 A 3/1995 Kawahara et al.
5,422,444 A 6/1995 Doragrip
RE35,216 E 4/1996 Anderson et al.
5,547,344 A 8/1996 Sugiyama et al.
5,596,879 A 1/1997 Burkhart et al.
5,723,827 A * 3/1998 Sasaki et al. ..... 181/237
5,733,108 A 3/1998 Riffe
5,883,342 A 3/1999 Wolpert (Continued)

*Primary Examiner* — Charles Freay
*Assistant Examiner* — Philip Stimpert
(74) *Attorney, Agent, or Firm* — Harness, Dickey & Pierce, P.L.C.

(57) ABSTRACT

A dual chamber discharge muffler for a compressor. The dual chambers of the discharge muffler are separated by a check valve that closes upon shutdown of the compressor, which in turn limits the amount of exhaust gases in the discharge muffler that are able to return to the compressor. The dual chambers are formed by dividing a muffler housing with a dividing plate. The dividing plate may also be adapted to receive a fastener that through mounts the muffler to the compressor.

19 Claims, 7 Drawing Sheets

(56) References Cited

U.S. PATENT DOCUMENTS

| | | | | |
|---|---|---|---|---|
| 5,984,045 | A * | 11/1999 | Maeda et al. | 181/254 |
| 6,017,205 | A | 1/2000 | Weatherston et al. | |
| 6,113,372 | A | 9/2000 | Lifson et al. | |
| 6,142,741 | A | 11/2000 | Nishihata et al. | |
| 6,158,989 | A | 12/2000 | Barito | |
| 6,171,084 | B1 * | 1/2001 | Wallis et al. | 418/55.1 |
| 6,176,687 | B1 | 1/2001 | Kim et al. | |
| 6,213,732 | B1 | 4/2001 | Fujio | |
| 6,225,566 | B1 | 5/2001 | Dienst | |
| 6,254,365 | B1 | 7/2001 | Nakanishi | |
| 6,264,443 | B1 * | 7/2001 | Barito | 418/1 |
| 6,312,233 | B1 | 11/2001 | Ahn et al. | |
| 6,341,662 | B1 | 1/2002 | Karlsson | |
| 6,398,520 | B2 | 6/2002 | Han | |
| 6,422,338 | B1 | 7/2002 | Menzel et al. | |
| 6,499,977 | B2 | 12/2002 | Barito et al. | |
| 6,658,885 | B1 | 12/2003 | Zhou et al. | |
| 6,837,335 | B2 | 1/2005 | Jankowski | |
| 7,174,991 | B1 | 2/2007 | Gunnarsson et al. | |
| 7,293,629 | B2 | 11/2007 | Nasuno et al. | |
| 7,380,637 | B2 | 6/2008 | Sieben et al. | |
| 2002/0006342 | A1 | 1/2002 | Han | |
| 2002/0006343 | A1 | 1/2002 | Barito et al. | |
| 2002/0176739 | A1 | 11/2002 | Goto et al. | |
| 2003/0108438 | A1 | 6/2003 | Kim et al. | |
| 2004/0165998 | A1 | 8/2004 | Tadano et al. | |
| 2004/0165999 | A1 | 8/2004 | Tadano et al. | |
| 2004/0234386 | A1 | 11/2004 | Chumley et al. | |
| 2004/0234387 | A1 | 11/2004 | Marshall et al. | |
| 2005/0025566 | A1 | 2/2005 | Hasegawa | |
| 2005/0276711 | A1 | 12/2005 | Marshall et al. | |

* cited by examiner

DUAL CHAMBER DISCHARGE MUFFLER

FIELD

This application claims the benefit of U.S. Provisional Application No. 60/872,589, filed on Dec. 1, 2006. The present disclosure relates to compressors and, more particularly, to compressors with an externally mounted discharge muffler.

BACKGROUND

The statements in this section merely provide background information related to the present disclosure and may not constitute prior art.

A class of machines exist in the art generally known as "scroll machines" for the displacement of various types of fluids. Such apparatus may be configured as an expander, a displacement engine, a pump, a compressor, etc., and many features of the present teachings are applicable to any one of these machines. For purposes of illustration, however, the disclosed machines are in the form of a hermetic refrigerant compressor. Generally, a scroll machine comprises two spiral scroll wraps of similar configuration, each mounted on a separate end plate to define a scroll member.

The two scroll members are typically inter-fitted together with one of the scroll wraps being rotationally displaced 180° from the other. The machine operates by orbiting one scroll member (the "orbiting scroll") with respect to the other scroll member (the "fixed scroll" or "non-orbiting scroll") to make moving line contacts between the flanks of the respective spirals, defining isolated, crescent-shaped pockets of fluid moving from an inlet to an outlet.

The spirals are commonly formed as involutes of a circle, and ideally there is no relative rotation between the scroll members during operation; i.e., the motion is purely curvilinear translation (i.e., no rotation of any line in the body). The fluid pockets carry the fluid to be handled from a first zone in the scroll apparatus where a fluid inlet is provided, to a second zone in the apparatus where a fluid outlet is provided. The volume of a sealed pocket changes as it moves from the first zone to the second zone. At any one instant in time, there will be at least one pair of sealed pockets; and when there are several pairs of seal pockets at once, each pair will have different volumes. In a compressor, the second zone (or outlet) is at higher pressure than the first zone (or inlet) and is physically located centrally in the apparatus, the first zone being located at the outer periphery of the apparatus.

Two types of contacts define the fluid pockets defined between the scroll members: axially extending tangential line contacts between the spiral faces or flanks of the wraps caused by radial forces ("flank sealing"), and area contacts caused by axial forces between the plain edge surfaces (the "tips") of each ramp and the opposite end plate ("tip sealing"). For higher efficiency, good sealing must be achieved for both types of contacts.

The concept of a scroll-type machine has been recognized as having distinct advantages. For example, scroll machines have high isentropic and volumetric efficiency, and, hence, are relatively small and lightweight for a given capacity. They are, typically, quieter and vibration-less than many compressors types because they do not use large reciprocating parts (e.g., pistons, connecting rods, etc.), and because all fluid flow is in one direction with simultaneous compression in plural opposed pockets, there are less pressure-created vibrations. Such machines also tend to have higher reliability and durability because of the relatively few moving parts utilized, the relatively low velocity of movement between the scrolls, and an inherent forgiveness to fluid contamination.

Scroll compressors should not be rotated in reverse, however, as the scrolls can become damaged. One way a scroll compressor may operate in reverse is when compressed refrigerant remaining in the discharge line returns to the compressor and cause the scrolls to run in reverse. This reverse rotation of the scrolls may damage compressor components, including the scrolls, as high-pressure fluid flows to the lower-pressure inlet side of the scrolls. Accordingly, a short discharge line minimizes the volume of refrigerant contained therein and, once the compressor has shut down, a minimal amount of gas will return to the compressor and cause the scrolls to run in reverse.

With an externally mounted muffler, a short discharge line is prone to break because the muffler's larger mass vibrates while the compressor is running. To correct this, the discharge tube for an externally mounted muffler may have generally a longer length of tubing to the compressor. The longer discharge tubing, however, increases the volume of refrigerant present in the discharge line and cause the scrolls to reverse orbit upon shut down.

SUMMARY

The present teachings provide a dual chamber discharge muffler for a compressor. The dual chambers of the discharge muffler are separated by a check valve that closes upon shutdown of the compressor, which in turn limits the amount of exhaust gases in the discharge muffler that are able to return to the compressor. The dual chambers are formed by dividing the muffler housing with a dividing plate. The dividing plate may receive a fastener that through mounts the muffler to the compressor.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
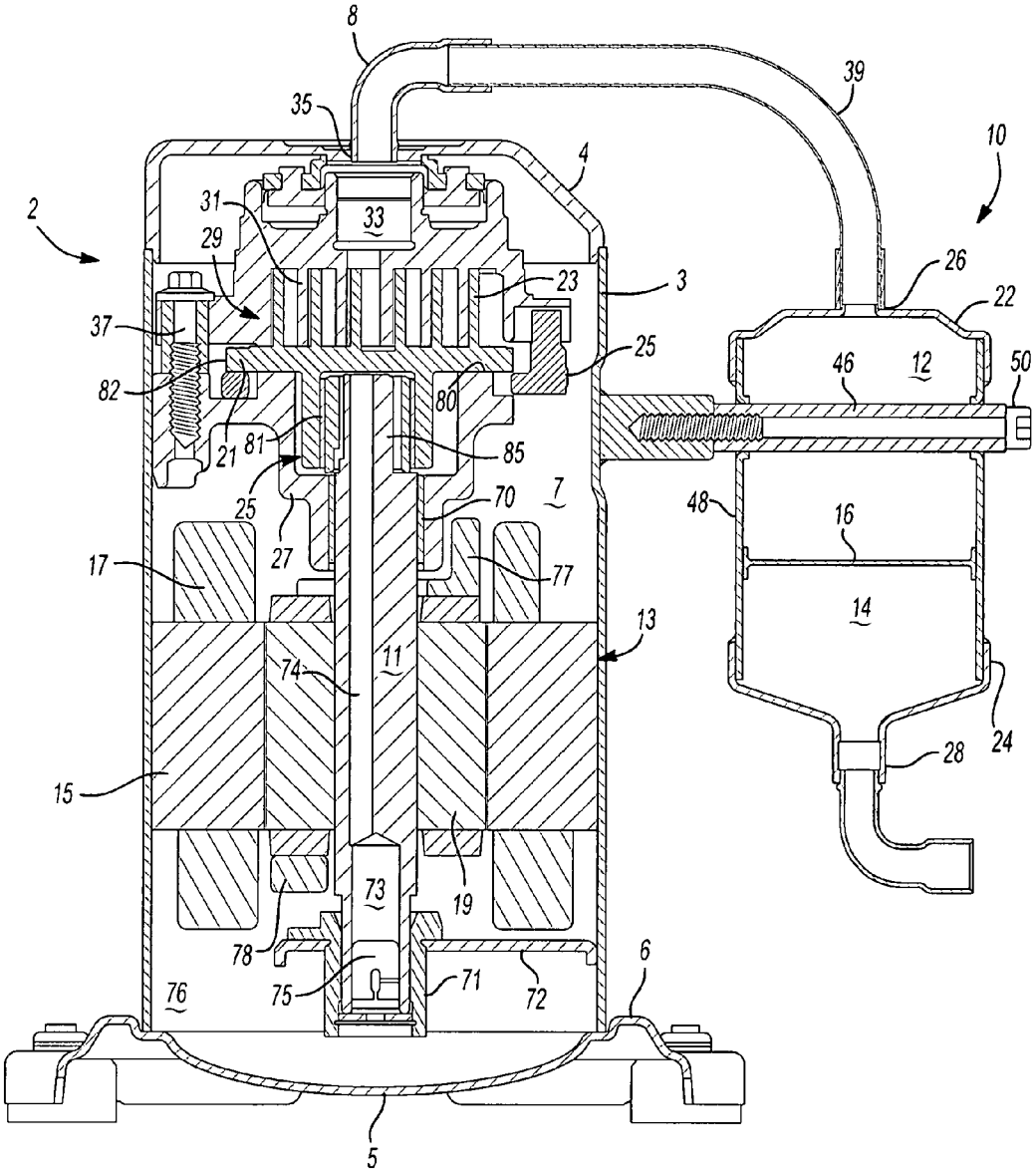
FIG. 1 is a cross-sectional view of a scroll compressor including a dual chamber discharge muffler according to the present teachings.

The following description is merely exemplary in nature and is not intended to limit the present disclosure, application, or uses. It should be understood that throughout the drawings, corresponding reference numerals indicate like or corresponding parts and features.

With particular reference to FIG. 1, the compressor 2 is shown to include a generally cylindrical hermetic shell 3 having a welded cap 4 at a top portion and a base 5 having a plurality of feet 6 welded at a bottom portion. The cap 4 and the base 5 are fitted to the shell 3 such that an interior volume 7 of the compressor 2 is defined. The cap 4 is provided with a discharge fitting 8 and an inlet fitting (not shown), disposed generally between the cap 4 and base 5. A discharge muffler system 10 according to the present teachings is in fluid communication with discharge fitting 8.

A drive shaft or crankshaft 11 having an eccentric crank pin 85 at the upper end thereof is rotatably journaled in a bearing 70 in the main bearing housing 27. A second bearing 71 is disposed in the lower bearing housing 72. The crankshaft 11 has a relatively large diameter concentric bore 73 at the lower end which communicates with a radially outwardly inclined small diameter bore 74 extending upwardly therefrom to the top of the crankshaft 11. A stirrer 75 is disposed within the bore 73. The lower portion of the interior shell 7 defines an oil sump 76 filled with lubricating oil to a level slightly below the lower end of a rotor 19, and the bore 73 acts as a pump to pump lubricating fluid up the crankshaft 11 and into the passageway 74 and ultimately to all of the various portions of the compressor which require lubrication.

The crankshaft 11 is rotatively driven by an electric motor including a stator 15 and windings 17 passing therethrough. The rotor 19 is press fitted on the crankshaft 11 and has upper and lower counterweights 77 and 78, respectively.

The upper surface of the main bearing housing 27 is provided with a flat thrust bearing surface 80 on which an orbiting scroll member 21 is disposed having the usual spiral vane or wrap 23 on the upper surface thereof. A cylindrical hub 25 downwardly projects from the lower surface of orbiting scroll member 21 which has a journal bearing 81 and a drive bushing 82.

Crank pin 85 has a flat on one surface which drivingly engages a flat surface formed in a portion of the drive bushing 82 to provide a radially compliant driving arrangement. An Oldham coupling 25 is provided positioned between the orbiting scroll member 21 and the bearing housing 27 and is keyed to the orbiting scroll member 21 and a non-orbiting scroll member 29 to prevent rotational movement of the orbiting scroll member 21.

Non-orbiting scroll member 29 also includes a wrap 31 positioned in meshing engagement with the wrap 23 of the orbiting scroll member 21. Non-orbiting scroll member 29 has a centrally disposed discharge passage 33, which communicates with an upwardly open recess 35 formed in outer surface of cap 4. Recess 35 is in fluid communication with the discharge fitting 8 such that compressed fluid exits the compressor 2. Non-orbiting scroll member 29 is designed to be fixedly mounted to bearing housing 29 by a fastener 37.

A dual chamber discharge muffler 10 according to the present teachings will now be described. The muffler 10 is attached to the shell 3 of the compressor 2 and, with particular reference to FIG. 2, includes a pair of chambers 12 and 14 separated by a dividing plate 16. To provide fluid communication between each of the chambers 12 and 14, the dividing plate 16 supports a check valve assembly 18.

The muffler 10 includes a generally cylindrical muffler housing 20, and a pair of end caps 22 and 24 connected to the housing 20 by welding or brazing. An upper cap 22 contains an inlet portion 26 of the muffler 10. The lower cap 24 contains an outlet portion 28 of the muffler 10. Materials for the housing 20, upper cap 22, and lower cap 24 include steel and aluminum. Notwithstanding, these components may be formed of any material known in the art that is of suitable strength and weight.

The dividing plate 16, as stated above, is a substantially planar plate that separates the muffler housing 20 into a pair of chambers 12 and 14. A first chamber 12, or inlet chamber 12, is disposed adjacent the inlet 26 of the muffler 10. A second chamber 14, or outlet chamber 14, is disposed adjacent the outlet 28 of the muffler 10. Fluidly connecting the inlet and outlet chambers 12 and 14 is the check valve assembly 18.

Figure 2:
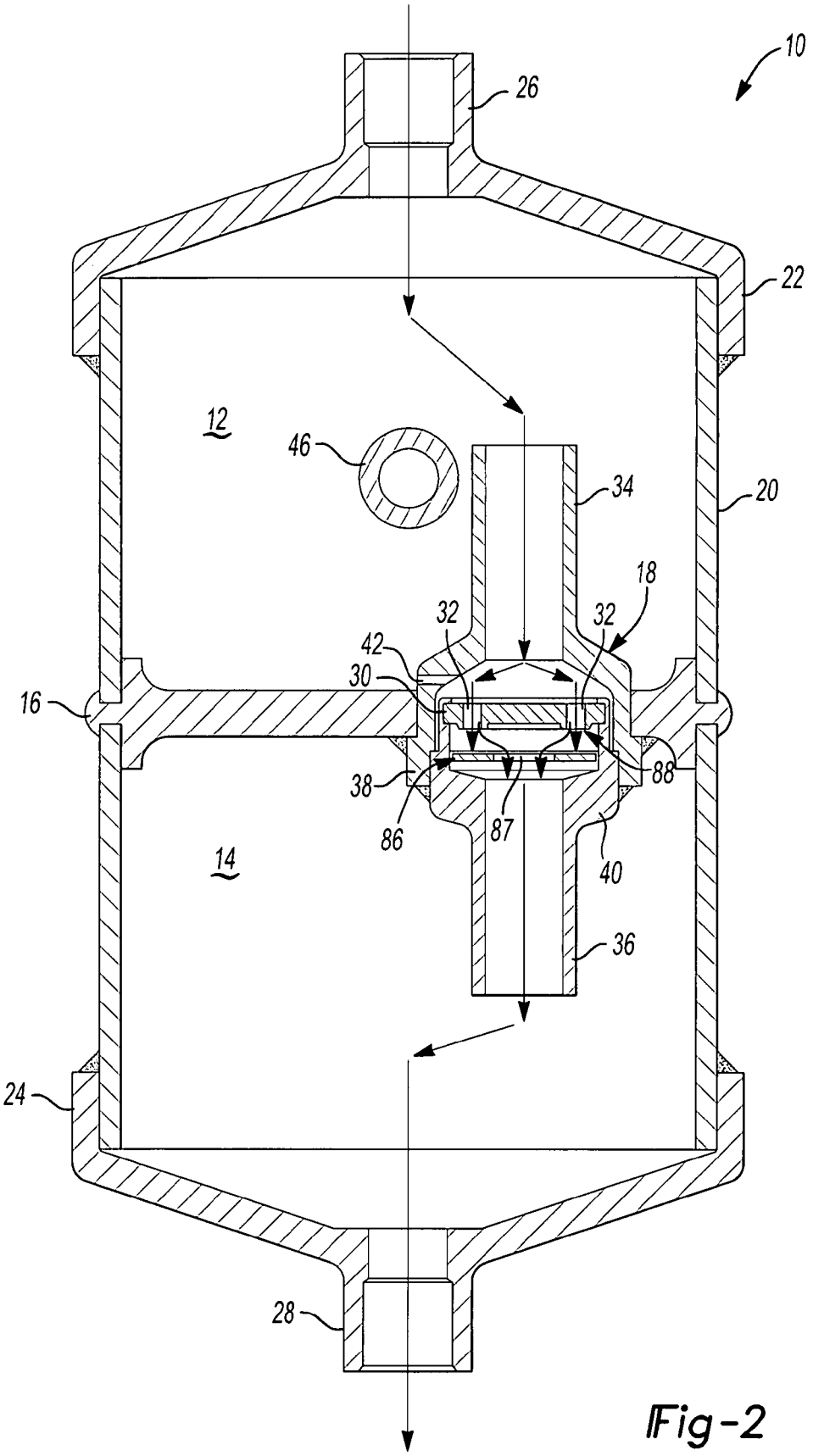
FIG. 2 is a cross-sectional view of a discharge muffler according to the present teachings.

Although the inlet and outlet chambers 12 and 14 are shown to be relatively equal in size in FIG. 2, the present teachings should not be limited to such a configuration. Alternatively, the size of the inlet and outlet chambers 12 and 14 may be unequal. It should be understood, however, that an important aspect of the present teachings is to provide a discharge muffler 10 that has a large enough volume to sufficiently reduce the discharge pulses emitted by the compressor 2. In this regard, the collective volume of the inlet and outlet chamber 12 and 14 must be large enough to effectively reduce the discharge pulses emitted by the compressor 2.

Check valve assembly 18 includes a check valve 86 which is a flat disc with a center opening 87. This opening 87 along with a pair of fluid pathways 32 in check valve seat 30 allow exhaust gases emitted by the compressor 2 to pass through muffler 10 as shown by the arrows in FIG. 2. When the compressor 2 is running, the compressor 2 emits exhaust gases that leave the compressor 2 through a discharge line 39 that enter the discharge muffler 10 through the inlet 26. Upon entry of the exhaust gases in the discharge muffler 10, a sufficient pressure gradient is formed in the muffler 10 to move check valve 86 off sealing surface 88 of valve seat 30 and to allow flow through pathways 32 in valve seat 30 and opening 87 in check valve 86. When the compressor 2 is not running or shuts down, the pressure gradient reduces sufficiently such that check valve 86 moves into contact with surface 88 of valve seat 30 closing opening 87 in check valve 30 and pathways 32 in valve seat 30 subsequently shutting off fluid communication between the inlet chamber 12 and the outlet chamber 14.

The check valve 86 preferably is disposed between a pair of fluid conduits 34 and 36 that are supported by the dividing plate 16. A first conduit 34, or extension 34, extends upward from the dividing plate 16 into the inlet chamber 12. A second conduit 36, or extension 36, extends downward from the dividing plate 16 into the outlet chamber 14. The first conduit 34 is provided with a portion 38 that is supported by the dividing plate 16. To connect the first conduit 34 to the dividing plate 16, the first conduit 34 is preferably attached by welding or brazing. The portion 38 connecting the first conduit 34 to the dividing plate 16 is configured to act as a fitting that is adapted to receive a fitting portion 40 of the second conduit 36. In this manner, the first and second conduits 34 and 36 can be securely fastened to each other by welding or brazing. Alternatively, the fitting 38 of the first conduit 34 can include a threading (not shown) that corresponds to a threading (not shown) formed on the fitting portion 40 of the second conduit 36.

Figure 3:
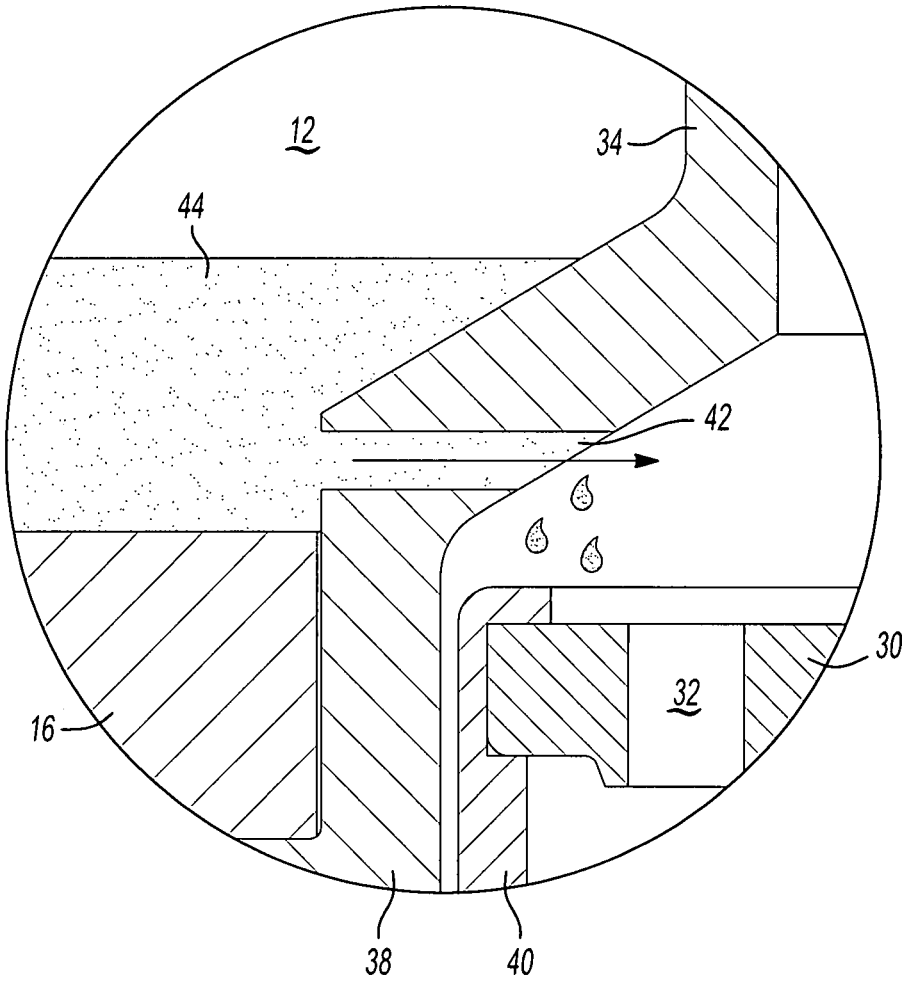
FIG. 3 is a close-up cross-sectional view of an oil discharge passage in accordance with the present teachings.

Referring to FIG. 3, a unique feature of the first conduit 34 is that it is provided with an oil passage 42. As best shown in FIG. 3, the oil passage 42 is formed in the fitting portion 38 or base 38 of the first conduit 34. Due to the expansion of the exhaust gas when it enters the muffler 10, the velocity of the exhaust gas will reduce. This reduction in gas velocity will allow some of the entrained oil in the gas to condense and drop out of the exhaust gas. Because of the length of the first conduit 34, the amount of oil 44 that may collect can be quite large.

Notwithstanding, the oil passage 42 allows any oil 44 that may collect in the inlet chamber 12 to drain slowly through the check valve 86. By controlling the drainage of the oil 44, the oil 44 is prevented from building up inside the check valve 86. The oil passage 42 allows the oil 44 to drain by gravity flow or by a pressure drop that will be caused by the exhaust gas flowing through the inlet chamber 12 across the pool of oil 44 at the bottom of the inlet chamber 12.

The effectiveness of the muffler 10 in reducing pressure pulsations in the compressor discharge gas flow is determined by the relative sizes of the inlet portion 26, muffler housing 20, inlet chamber 12, outlet chamber 14, and conduits 34 and 36. It is a preferred configuration of this design that partition 16 be located approximately half-way between inlet portion 24 and outlet portion 26. Further, it is preferred that the combined length of conduits 34 and 36 be approximately equal to one-half the distance between inlet portion 24 and outlet portion 26. It should also be understood that the individual lengths and diameters of the conduits 34 and 36 may be adjusted (i.e., lengthened or widened, respectively). In other words, the lengths and diameters of the conduits 34 and 36 may be approximately the same or different.

Figure 4:
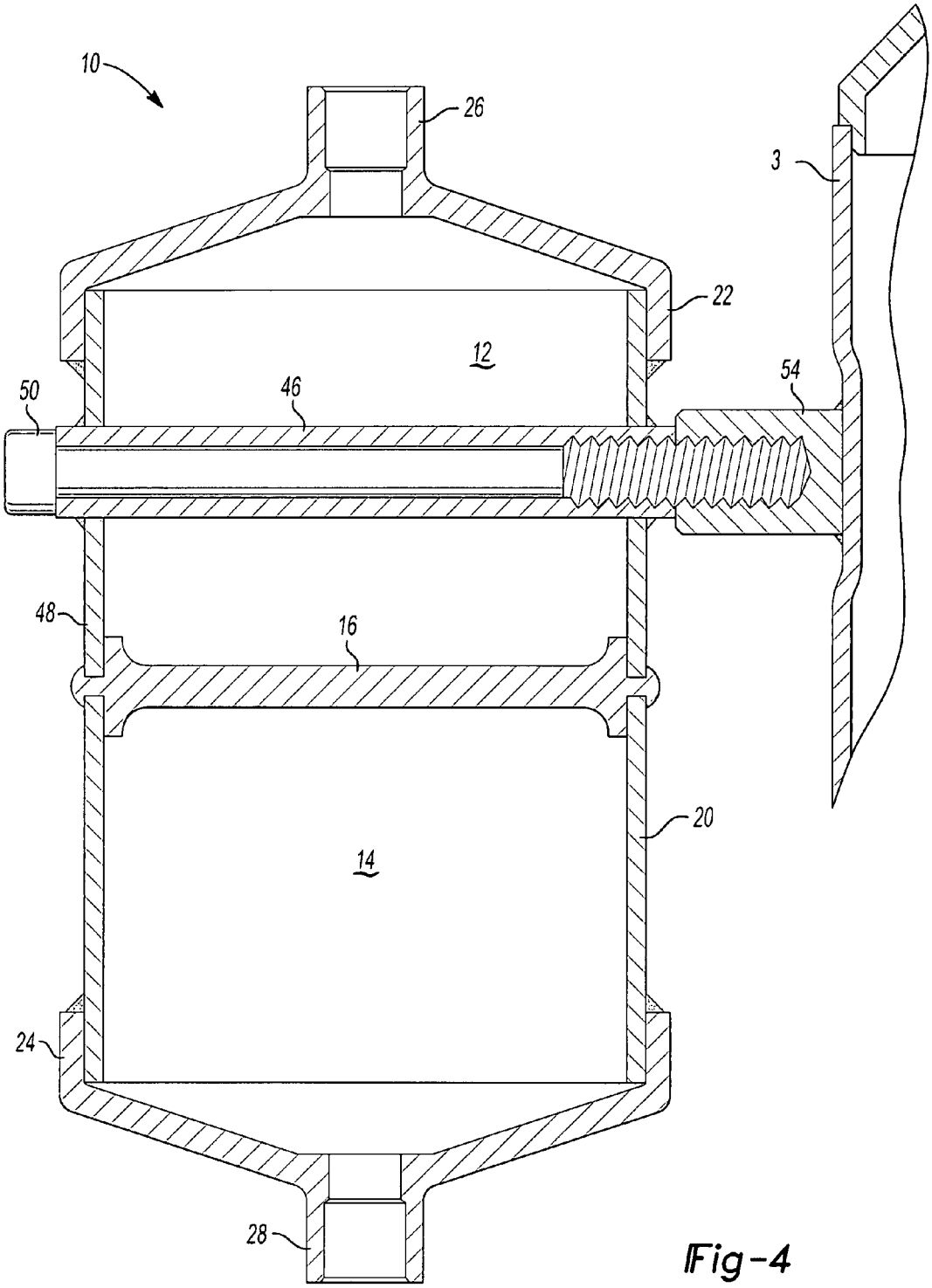
FIG. 4 is a cross-sectional view depicting a method of attaching the dual chamber discharge muffler to a compressor.

Referring to FIG. 4, to connect the discharge muffler 10 to the compressor 2, the discharge muffler 10 is provided with an internal sleeve or spacer 46. The spacer 46 is, by way of non-limiting example, a generally cylindrical shaped sleeve that passes through a central portion 48 of the muffler housing 20. That is, the spacer 46 is diametrically disposed through the muffler housing 20. To connect the spacer 46 to the muffler housing 20, the spacer 46 may be brazed or welded to the muffler housing 20.

The spacer 46 provides a pathway for a fastener 50 such as a bolt or screw that fixes the discharge muffler 10 to the compressor shell 3. To fix the discharge muffler 10 to the compressor shell 3, the fastener 50 is coupled to a spud 54 which is fixedly attached to the compressor shell 3. The spud 54 may be attached to the compressor shell 3 by welding or brazing, or in any method known to one skilled in the art.

Although the spacer 46 is described and shown as being diametrically disposed through the central portion 48 of the muffler housing 20, the present teachings should not be limited thereto. That is, the spacer 46 assists in rigidly securing the muffler 10 to the shell 3 of the compressor 2 by controlling a center of mass of the muffler 10. By controlling the center of mass of the muffler 10, vibration of the muffler 10 during operation of the compressor 2 can be eliminated, or at least substantially minimized. Accordingly, the spacer 46 may used to connect the muffler 10 to the shell 3 of the compressor 2 in any manner that is sufficient in controlling a center of mass of the muffler 10. That is, it is contemplated that the spacer 46 may be attached to an outer surface of the muffler housing 20 without departing from the spirit and scope of the present teachings.

As stated above, the discharge muffler 10 is rigidly mounted to the compressor shell 3 in a manner such that vibrations are eliminated, or at least substantially minimized. Moreover, by mounting the discharge muffler 10 to the compressor shell 3 in this manner, the discharge line 39 needed to supply the exhaust gases from the compressor 2 into the discharge muffler 10 is kept at a minimal length. Accordingly, any exhaust gas present in the discharge line 39, and in turn the discharge muffler 10, is kept to a minimum such that upon shutdown of the compressor 2 the discharge gas will not return through the discharge line 39 to the compressor 2 and run the scrolls 21 and 29 in reverse. Damage to the sensitive scroll components of the compressor 2, therefore, can be avoided.

The dual chambers 12 and 14 separated by the check valve 86 also assist in this manner. That is, as stated above, when the compressor 2 is not operating or shuts down, the pressure gradient present in the discharge muffler 10 will reduce sufficiently to allow the fluid pathways 87 of the check valve 86 to close. As such, the amount of exhaust gases that are able to flow back into the compressor 2 and cause reverse rotation of the scrolls 21 and 29 is further reduced. This is because the only exhaust gas that may flow back into the compressor 2 will be the exhaust gases in the discharge line 39 that leads to the muffler 10, as well as the exhaust gases present in the inlet chamber 12 of the muffler 10.

Accordingly, as stated above with reference to FIG. 2, the inlet chamber 12 and outlet chamber 14 may have differing volumes. In this regard, it may be preferable to have an inlet chamber 12 with a volume that is sufficiently less than the volume of the outlet chamber 14 to reduce the amount of exhaust gases that are able to return to the compressor 2 on shutdown. Alternatively, the volume of the inlet chamber 12 may be greater than the volume of the outlet chamber 14. Regardless, it should be understood that the volume of the inlet chamber 12 should be a sufficient size to both reduce the discharge pulses emitted by the compressor 2 and reduce the amount of exhaust gas that may return to the compressor 2 on shutdown.

Figure 5A:
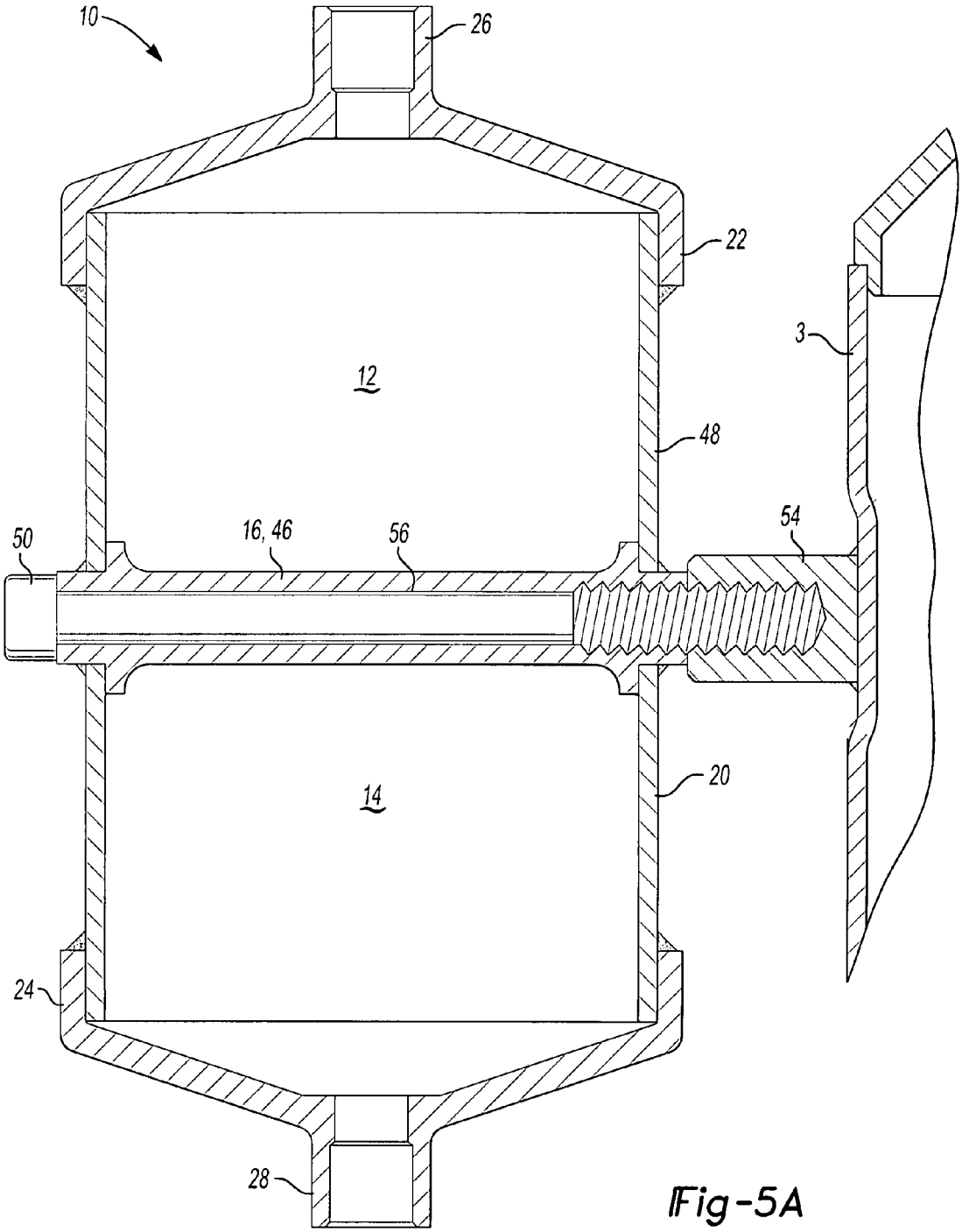
FIGS. 5A and 5B are cross-sectional views depicting another method of attaching the dual chamber discharge muffler to the compressor.
Figure 5B:
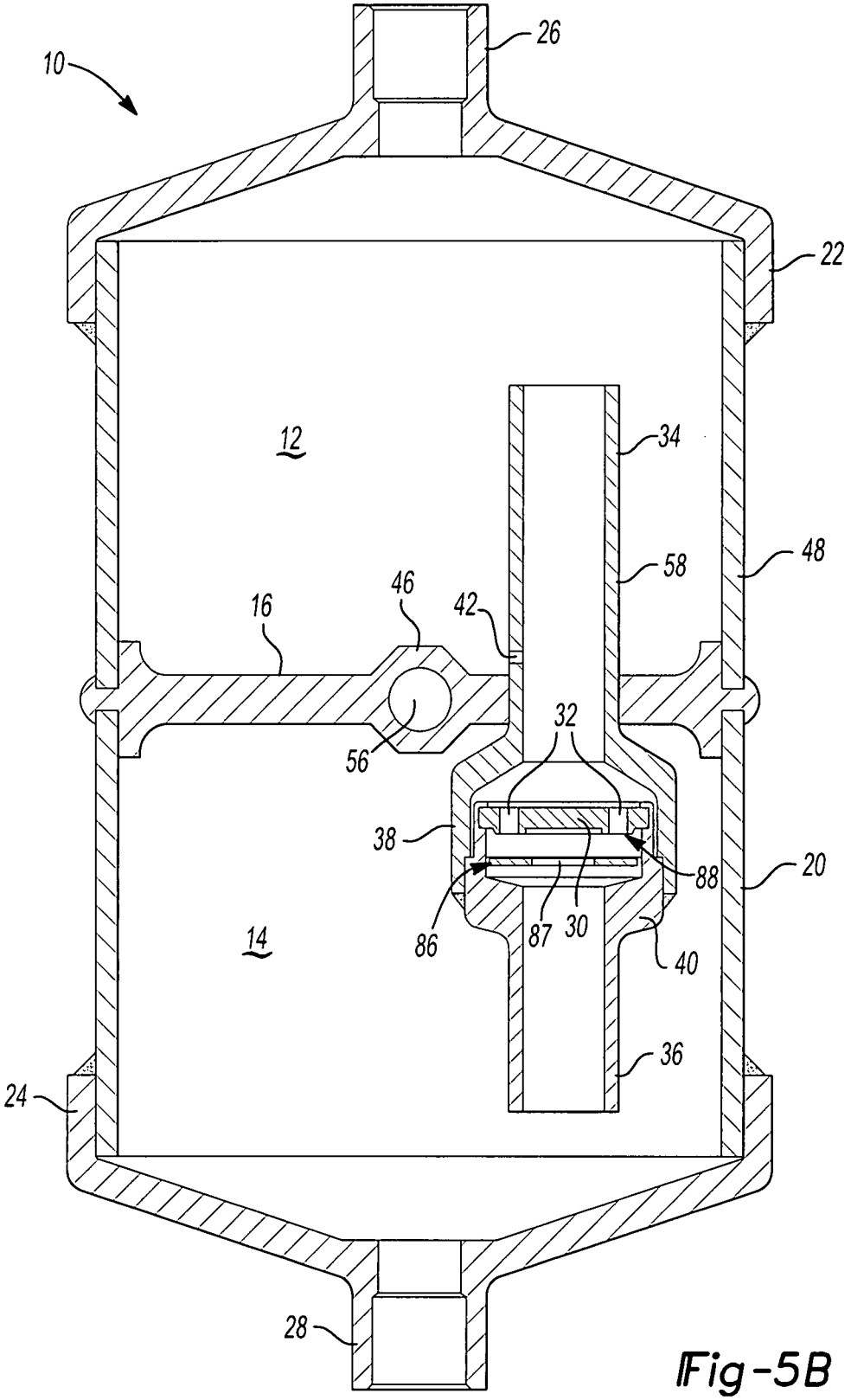

Now referring to FIGS. 5A and 5B, the dividing plate 16 has been adapted to act as the spacer 46 for receiving the fastener 50 that secures the discharge muffler 10 to the compressor shell 3. The dividing plate 16 is provided with a cylindrical through hole 56 that passes diametrically though the muffler housing 20. The through hole 56 is adapted to act as the spacer 46 that receives the fastener 50 that rigidly secures the muffler 10 to the compressor shell 3. By configuring the dividing plate 16 to additionally act as the spacer 46, the number of components that compose the muffler 10 can be reduced to reduce manufacturing costs, as well as reduce manufacturing time.

To provide room for the through hole 56 adapted to act as a spacer 46, the dividing plate 16 is configured to support an extension portion 58 of the first conduit 34. In this manner, the fitting portions 38 and 40 that connect the first conduit 34 and second conduit 36 are disposed in the outlet chamber 14 of the discharge muffler 10. Further, the check valve 86 that is supported between the fitting portions 38 and 40 of the first and second conduits 34 and 36 is also disposed in the outlet chamber 14. Regardless, it should be understood that the fitting portions 38 and 40 may also be disposed in the inlet chamber 12 without departing from the spirit and scope of the present teachings. Further, the oil discharge outlet 42 is formed in the extension portion 58 of the first conduit 34. Accordingly, oil 44 and fluid is able to drain from the inlet chamber 12 to the outlet chamber 14 through the check valve 86 as well.

Figure 6:
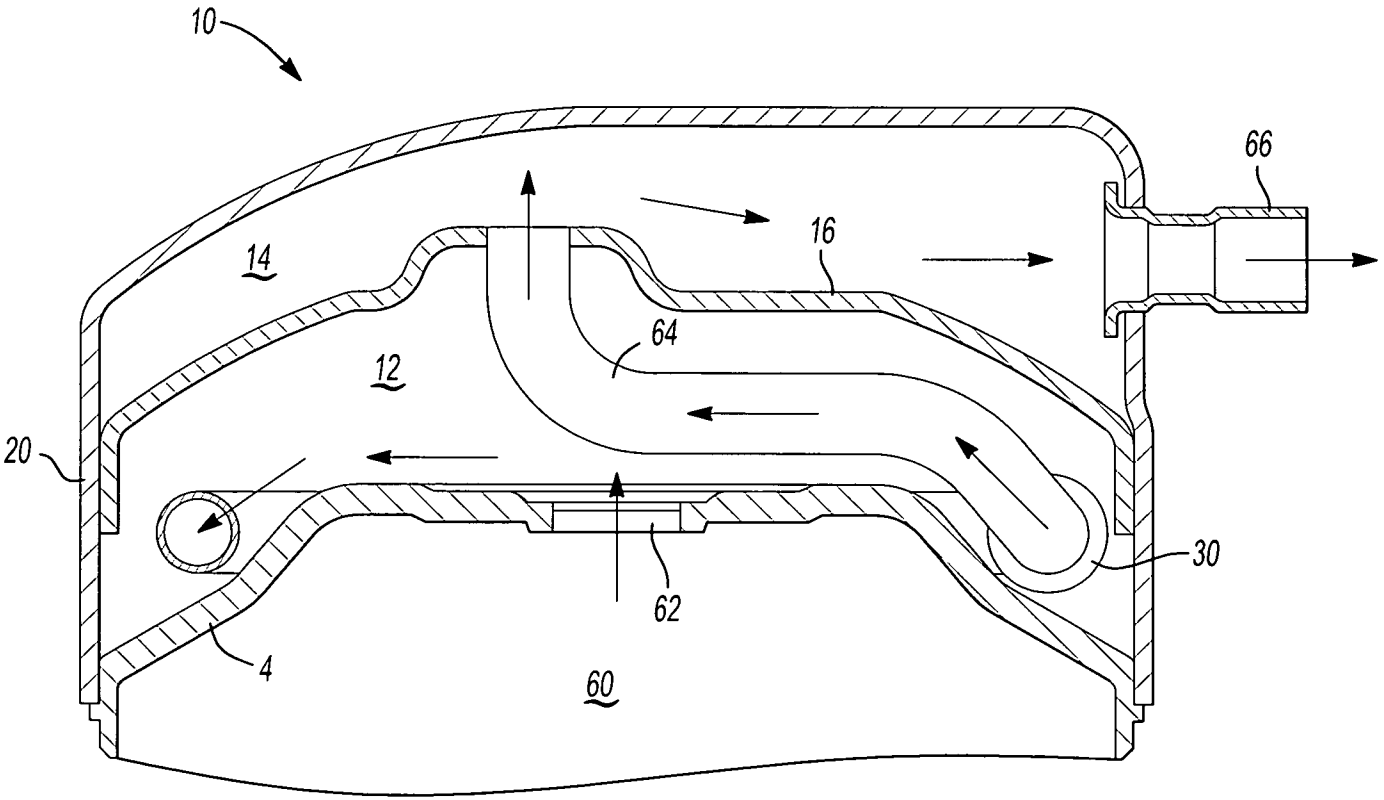
FIG. 6 is a cross-sectional view of another dual chamber discharge muffler according to the present teachings.

Although the present teachings have been described relative to an externally mounted discharge muffler 10, the present teachings should not be limited thereto. In contrast, the present teachings are also adaptable to a discharge muffler 10 that is integral with the compressor 2. As shown in FIG. 6, the dual chamber discharge muffler 10 has been adapted to fit on top of the compressor 60. The inlet chamber 12 of the discharge muffler 10 is directly adjacent the outlet 62 from the compressor 60 and is fluidly connected to the outlet chamber 14 of the muffler by a tube or hose 64.

As exhaust gases exit the compressor 60, the gases will travel through the first chamber 12 and enter the tube 64 as shown by the arrows in FIG. 6. Present within the tube 64 is a check valve 30 that operates like the check valves described above relative to the other configurations. More particularly, as exhaust gases enter the inlet chamber 12 of the muffler 10, the pressure gradient in the chamber 12 will rise to a point that the fluid pathways of the check valve 30 will open to allow fluid communication between the inlet chamber 12 and the outlet chamber 14. The gases will then enter the outlet chamber 14 and exit the muffler 10 through an exhaust fitting 66. The tube 64 that houses the check valve 30 may be a flexible tube made of an elastomeric, rubber, or polymeric material. Notwithstanding, the tube 64 may also be formed of a metal material such as copper or aluminum.

When the compressor 60 has shut down, the pressure gradient in the inlet chamber 12 will lower to a point such that the fluid pathways of the check valve 30 will close to shut down fluid communication between the inlet chamber 12 and the outlet chamber 14. Accordingly, only gases present in the tube 64 and inlet chamber 12 will be able to reenter the compressor 60. In this manner, the reverse rotation of the scrolls 21 and 29 will be effectively and substantially minimized.

It should be understood that although the present teachings have been described relative to use with a scroll compressor, the present teachings should not be limited thereto. In contrast, the discharge mufflers of the present teachings are adaptable to any type of compressor known in the art including rotary, reciprocating, and orbiting types because the mufflers of the present teachings are proficient in reducing discharge pulses emitted by a compressor, reducing a temperature of the exhaust gases, and preventing the build up of back pressure in the compressor.

What is claimed is:

1. A compressor comprising:

a shell;

a compression mechanism disposed within said shell;

a muffler proximate said shell, said muffler including a first chamber and a second chamber defined by a housing;

a spacer disposed through said housing, said spacer receiving a fastener that fixes said muffler to said shell; and a check valve assembly disposed between said first chamber and said second chamber that enables fluid communication between said first chamber and said second chamber.

2. The compressor of claim 1, wherein said check valve assembly includes a check valve disposed between a first conduit and a second conduit, said first conduit extending into said first chamber and said second conduit extending into said second chamber.

3. The compressor of claim 2, wherein said first and second conduits have different lengths or diameters.

4. The compressor of claim 2, wherein said first and second conduits have approximately the same length and diameter.

5. The compressor of claim 2, wherein said first conduit includes an oil discharge port formed in a surface of said first conduit.

6. The compressor of claim 5, wherein said oil discharge port is formed in said surface of said conduit at a base of said conduit.

7. The compressor of claim 1, wherein a volume of said first and second chambers is different.

8. The compressor of claim 1, wherein a volume of said first and second chambers is approximately the same.

9. The compressor of claim 1, wherein said first and second chambers are separated by a dividing plate disposed within said housing.

10. The compressor of claim 9, wherein said dividing plate supports said check valve assembly.

11. The compressor of claim 1, wherein said muffler is externally attached to said shell.

12. The compressor of claim 1, wherein said compression mechanism comprises:

a first scroll member disposed within said shell, said first scroll member having a first spiral wrap;

a second scroll member disposed within said shell, said second scroll member having a second spiral wrap intermeshed with said first spiral wrap of said first scroll member; and a drive member adapted to cause said first and second scroll members to orbit relative to one another.

13. The compressor of claim 1, wherein said first chamber is upstream of said second chamber.

14. The compressor of claim 13, wherein a volume of said first chamber is less than a volume of said second chamber.

15. The compressor of claim 13, wherein a volume of said first chamber is greater than a volume of said second chamber.

16. The compressor of claim 1, wherein a spud is fixed to said shell that couples to said fastener.

17. The compressor of claim 16, wherein said spud receives said fastener.

18. The compressor of claim 1, wherein said housing includes a pair of openings for supporting said spacer.

19. The compressor of claim 1, wherein said spacer passes entirely through said housing.

* * * * *